United States Patent [19]

Beton

[11] Patent Number: 5,048,740

[45] Date of Patent: Sep. 17, 1991

[54] FASTENER SETTING TOOLS

[75] Inventor: Richard J. Beton, South Blackburn, Australia

[73] Assignee: Ramset Fasteners (Aust.) Pty. Limited, Croyden North, Australia

[21] Appl. No.: 459,717

[22] PCT Filed: Jul. 13, 1988

[86] PCT No.: PCT/AU88/00255

§ 371 Date: Jan. 10, 1990

§ 102(e) Date: Jan. 10, 1990

[87] PCT Pub. No.: WO89/00483

PCT Pub. Date: Jan. 26, 1989

[30] Foreign Application Priority Data

Jul. 15, 1987 [AU] Australia ..... PI3101

[51] Int. Cl.[5] ..... B25C 1/14

[52] U.S. Cl. ..... 227/10

[58] Field of Search ..... 227/10, 9, 8

[56] References Cited

U.S. PATENT DOCUMENTS 3,066,302 12/1962 De Caro et al. ..... 227/10
3,168,744 2/1965 Kvalve ..... 227/10
3,549,074 12/1970 Brunelle ..... 227/10
3,565,313 2/1971 Mittelfeld et al. ..... 227/10
3,820,703 6/1974 Rangger ..... 227/10
4,364,506 12/1982 Schneider ..... 227/10

FOREIGN PATENT DOCUMENTS 2315106 10/1974 Fed. Rep. of Germany ..... 227/10

*Primary Examiner*—Frank T. Yost
*Assistant Examiner*—John M. Husar
*Attorney, Agent, or Firm*—Harness, Dickey & Pierce

[57] ABSTRACT

An explosively-actuated fastener setting tool comprises a barrel which can be moved forwardly after firing in order to open a breach for loading of a fresh charge. Forwards movement of the barrel also enables a spring-loaded stop to pivot through a slot in the barrel and engage the head of a firing piston to thereby reset the piston in the barrel. In the normal, breach-closed position of the barrel, the stop is fully retracted from the barrel. The configuration permits increased opening movement of the barrel. Further stops between the barrel and tool body engage in a forward position of the barrel to prevent the rear end of the barrel slot from impacting against the pivotal stop.

8 Claims, 4 Drawing Sheets

SECTION Y

FASTENER SETTING TOOLS

The present invention relates to explosively actuated tools for setting fasteners such as nails or pins into a substrate composed of a relatively hard material such as concrete, masonry, or steel.

FIGS. 1 to 4 show an explosively actuated setting tool of the type disclosed in U.S. Pat. No. 3,066,302. In these figures, FIGS. 1 and 2 show respectively, a receiver assembly and a barrel assembly, and FIG. 3 shows the barrel assembly mounted in the receiver assembly, with the tool ready to fire. FIG. 4 shows the barrel assembly pulled into a forward position to open a breach of the tool for re-setting a firing piston and for loading a fresh charge.

The barrel assembly comprises a barrel 2 containing a firing piston 4. A charge chamber 6 at the rear of the barrel 2 receives an explosive charge 8 which is fired by a firing pin 10 in the receiver assembly (FIG. 1) to propel the piston 4 forwardly to drive a fastener 12 positioned in the forward end of the barrel into a substrate. A slot 14 formed in the underside of the barrel 2 is adapted to receive a spring-loaded stop pawl 16 for re-setting the piston 4 after firing, the pawl 16 being carried at the front end of the receiver assembly. At the forward end of the slot 14, a cam surface 18 acts to displace the pawl 16 out of the path of the piston 4 when the barrel 2 is in its rearward, ready-to-fire position as shown in FIG. 3. When the tool has been fired, the piston 4 normally stops with its head 4*a* positioned just behind the pawl 16, this stop position being obtained when the forward end of the piston 4 is at the forward end of the barrel 2, with the fastener having been driven fully home into the substrate so that its head flush with the surface of the substrate. The cam 18 displaces the pawl 16 out of the possible path of the piston head 4*a* in case the piston 4 over-drives the fastener into the substrate should the substrate be unusually soft.

In order to reset the tool after firing, the barrel assembly is moved forwardly into the position shown in FIG. 4. At the start of this movement, the cam 18 moves with the barrel 2 forwardly away from the pawl 16 thus allowing the pawl 16 to move upwardly through the slot 14 to engage the front face of the piston head 4*a* and prevent the piston 4 moving forwardly with the barrel 2. When the barrel is in its forward position (FIG. 4), the piston head 4*a* is at the back end of the barrel 2 and has thus been reset relative to the barrel 2 in preparation for the next firing. In the forward position of the barrel 2 the breach 20 is opened behind the barrel 2 to permit extraction of the previous charge 8 and loading of the fresh charge.

In this previously proposed tool, the pawl 16 always lies within the slot 14 in the barrel 2, but in the rearmost position of the barrel 2 (the ready-to-fire configuration of the tool), the pawl 16 is held by the cam 18 out of the possible path of the piston head 4*a*. The length of the slot 14, and thus the degree of opening of the barrel is determined by the maximum length of fastener which can be driven by the tool. Tools designed for relatively short fasteners accordingly have only a limited degree of opening, and hence only a restricted access which may cause difficulties in removal of the fired charge and loading of the fresh change. These difficulties become apparent for operatives who wear protective gloves and/or work in cold conditions.

According to the present invention, there is provided an explosively-actuated tool for setting a fastener into a substrate, comprising a body, a barrel containing a firing piston operative upon detonation of an explosive charge to drive a fastener in the forward end of the barrel, said barrel being movable in the body from a rear position in which the tool is ready to fire to a forward position in which a breach is opened for loading of a fresh charge and stop means carried by the body and extendable into the barrel to engage the piston during the forward movement of the barrel to reset the piston rearwardly relative to the barrel in preparation for the next firing, said stop means being mounted for movement out of the barrel upon subsequent rearwards movement of the barrel to close the breach.

Preferably, the stop means is pivotal between its operative and retracted positions.

An embodiment of the invention will now be described, by way of example only, with reference to the accompanying drawings, in which.

Figure 1:
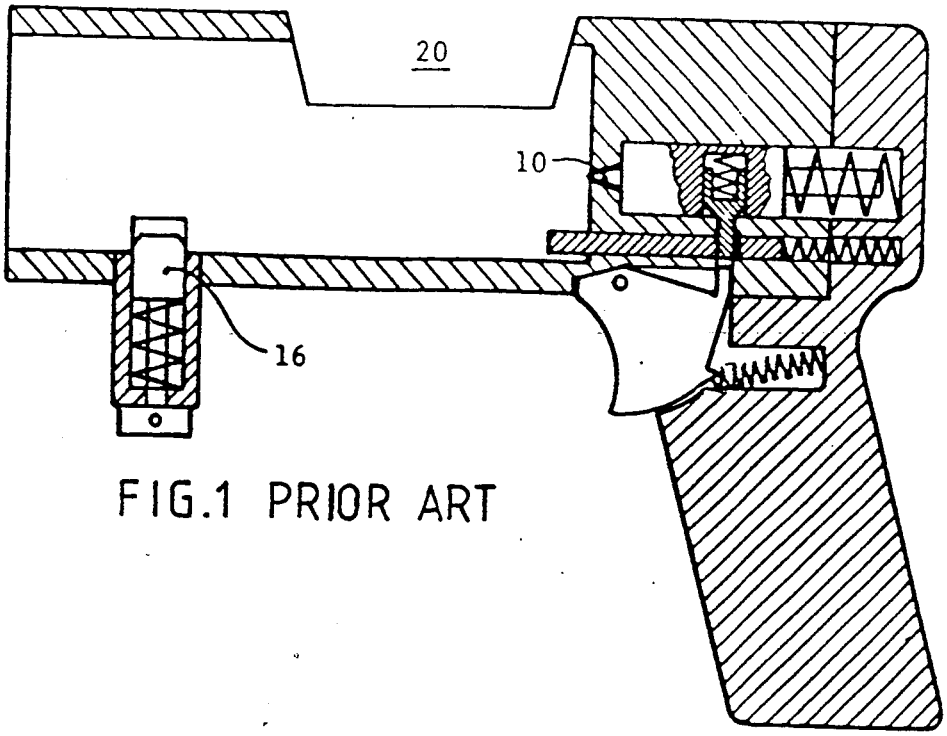
FIG.1 PRIOR ART
Figure 2:
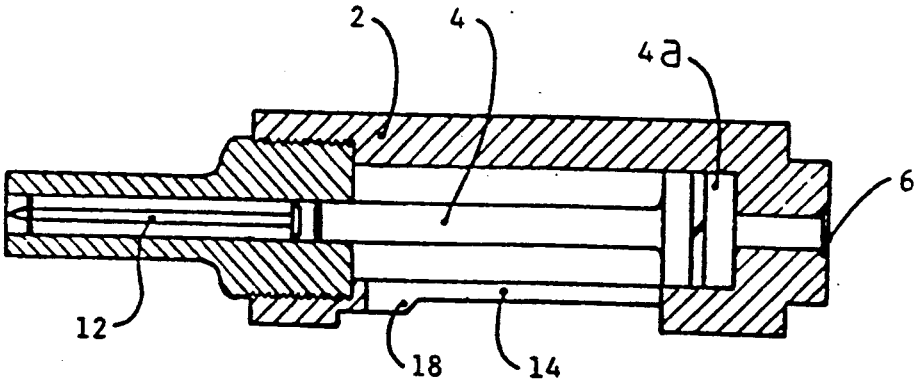
FIG.2 PRIOR ART
Figure 3:
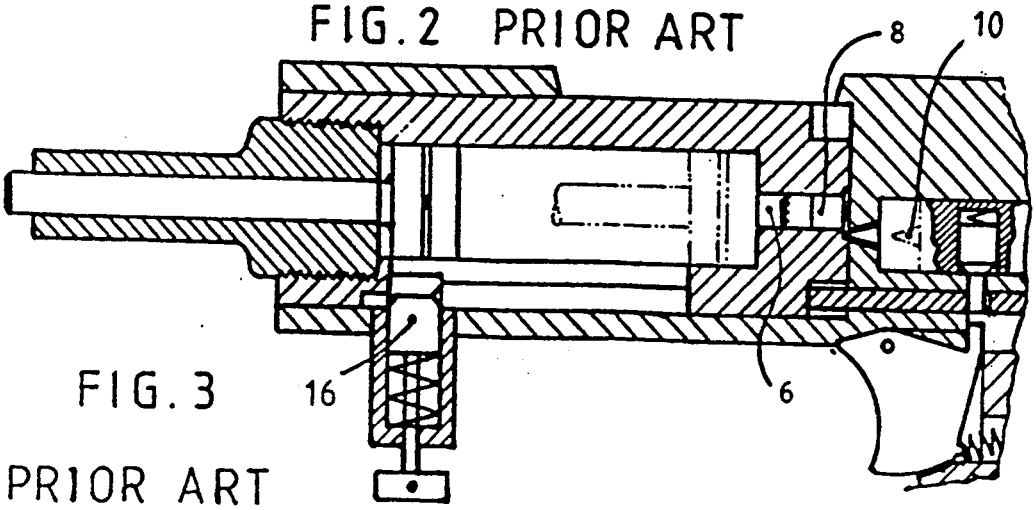
FIG.3 PRIOR ART
Figure 4:
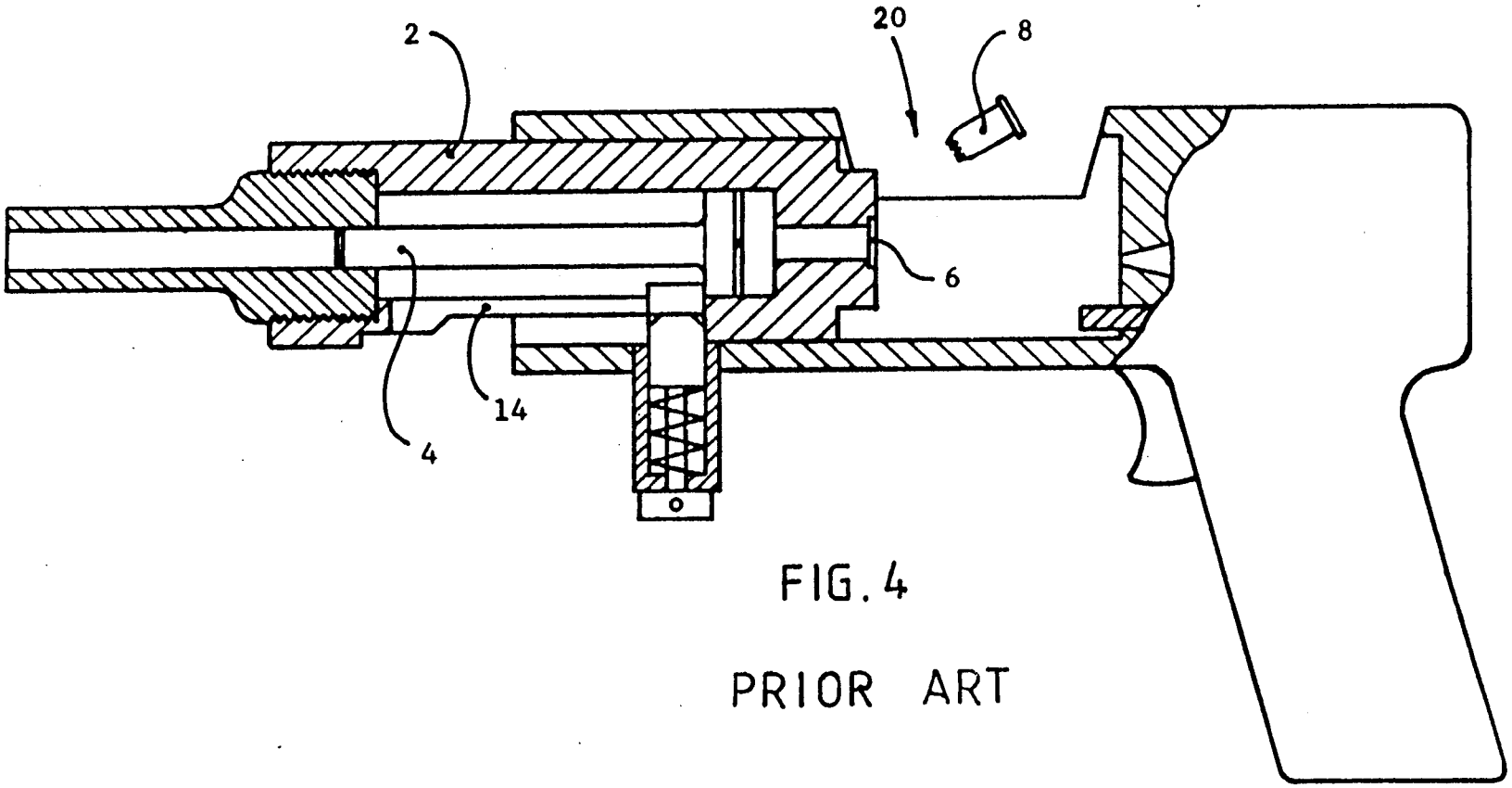
FIG. 4 PRIOR ART

The tool of the preferred embodiment of the invention differs from that of FIGS. 1 to 4 primarily in the configuration and operation of the stop pawl. More particularly, the slot 14 opens downwardly into a larger slot 15 and a stop pawl 30 carried at the front end of the receiver assembly is pivotally mounted. The pawl 30 comprises a guide portion 32 adapted to ride along the underside of the slot 14 in the barrel 2 and a stop portion 34 which projects through the slot 14 into the path of the piston head 4*a*. An inclined ramp surface 36 is formed at the forward side of the stop portion 34. A torsion spring 38 acts on the pawl 30 to pivotally bias the pawl 30 into its operative position in which its stop portion 34 projects through the slot 14.

In the ready-to-fire position of the tool (FIG. 5) the forward end of the slot 14 is positioned a substantial distance behind the pawl 30 which has pivoted into a retracted position fully removed from the barrel 2, to lie beneath the forward end of the barrel 2. The retraction of the pawl 30 completely from the barrel 2 means that the stroke of the barrel between its rear position and its forward open position is no longer limited by the length of the slot 14 and thus the maximum length of the fastener being fired and, therefore, the stroke of the barrel can be extended to permit sufficient, and increased, access to the opened breach 20 behind the barrel 2 even with tools designed for use with short fasteners.

The increased opening movement also permits driving of an automatic loading mechanism (if required) for the charges and/or the fasteners due to the increased mechanical advantage derived from the increased stroke length of the barrel.

The construction will now be described in greater detail.

Figure 5:
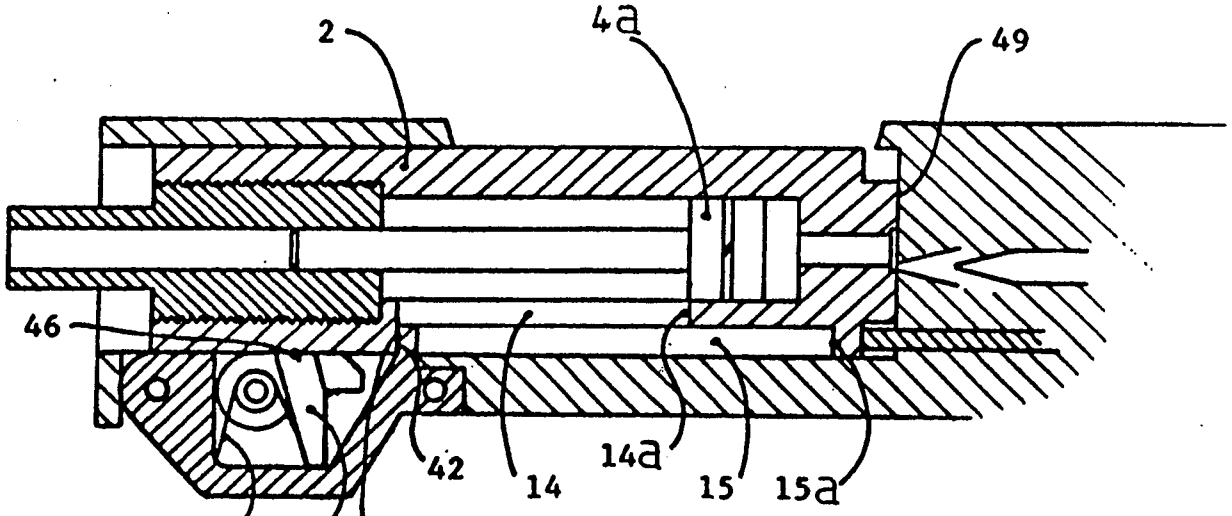
FIG. 5 shows a tool in accordance with our embodiment of the invention in its ready-to-fire configuration.
Figure 6:
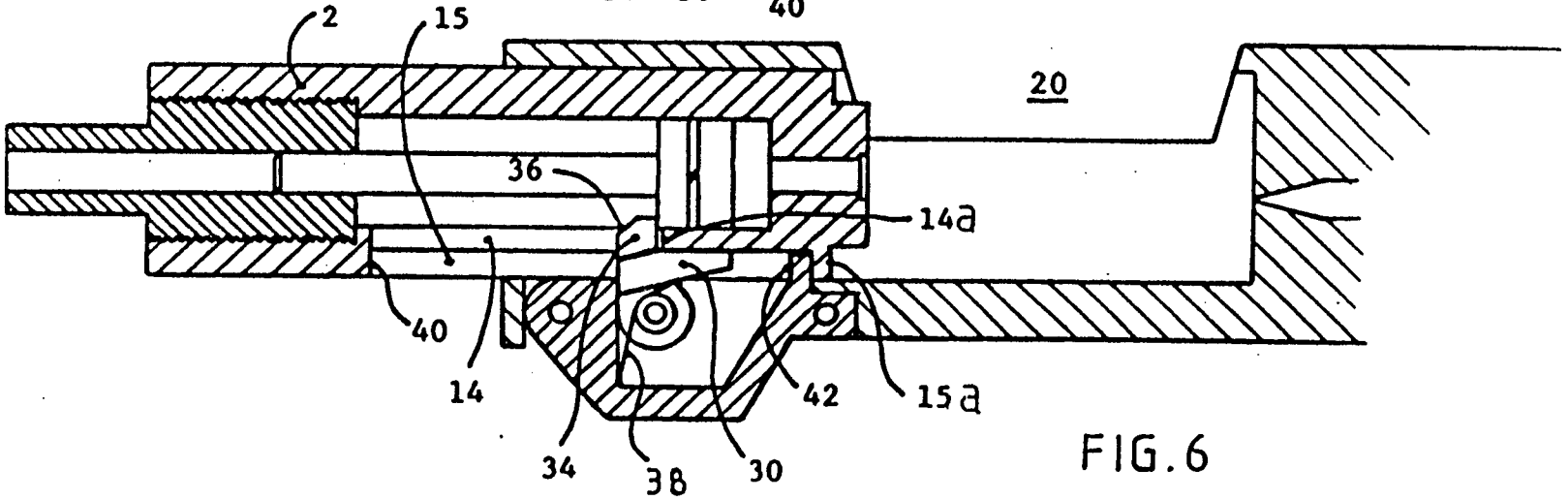
FIG. 6 shows the tool of FIG. 5 with the barrel in its fully open position.

In the ready to fire position of FIG. 5, the firing mechanism, which will be described subsequently, has been cocked upon rearward pressure having been applied to the front of the barrel 2 consequent on the operator forcing the barrel against the substrate.

In this position, the pawl 30 has swung out of its operative position, against the bias of the torsion spring 38 so that a face 46 of the pawl 30 lies against the underside of the forward end of the barrel. Also in this position, a shoulder 40 at the end of the slots 14 and 15 is just clear of a stop 42 on the receiver assembly so that the stop 42 is not subject to the recoil forces at firing, these forces being taken through breech faces 49. In this position, the stop 42 controls the radial alignment, as well as the forward movement, of the barrel 2, by engaging the sides of the slot 15.

Although in the embodiment shown, the stop acts in conjunction with the slot 15 through which the pawl 30 projects into the slot 14, a separate slot, angularly displaced from the slot 14 may be provided for controlling the barrel alignment and movement in conjunction with an appropriate stop on the receiver assembly.

After firing, the barrel 2 is moved forwardly by the operator. As the forward end of the slots 14 and 15 passes over the pawl 30, the pawl pivots upwardly under its spring bias so that the stop portion 34 enters the slots 14 and 15 with the guide portion 32 resting against the underside of the slot 14. The stop portion 34 thereby lies in front of the path of the piston head 4*a* to stop the piston and therefore reset the piston 4 relative to the barrel 2 upon further forward movement of the barrel. The forward stop position of the barrel 2 is defined by engagemet of a shoulder 15*a* at the rear end of the slot 15 with the rear face of the stop 42 on the receiver assembly. In this position a small clearance is left between a shoulder 14*a* at the rear end of the slot 14 and the rear face of the pawl 30, thus ensuring that the relatively fragil pawl 30 is required to restrain only the piston 4 and is not subjected to high impact loads generated when the barrel is vigorously pulled or 'thrown' forward.

The barrel 2 may then be moved to its closed position, the piston 4 having been reset in the barrel 2 and a fresh charge and fastener having been loaded. Towards the end of the closing movement, the forward end of the slots 14 and 15 engages the inclined ramp surface 36 of the pawl 30 and pivots the pawl 30 downwardly to permit the forward end of the barrel 2 to move past the pawl 30.

Figure 9:
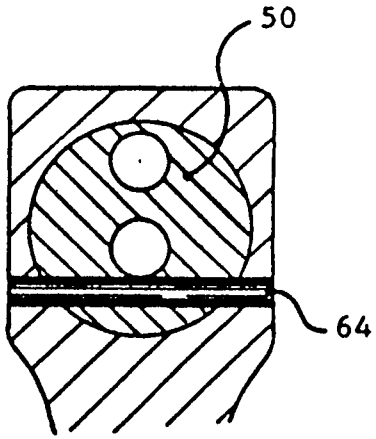
FIG. 9 is a section on line Y of FIG. 8.
Figure 8:
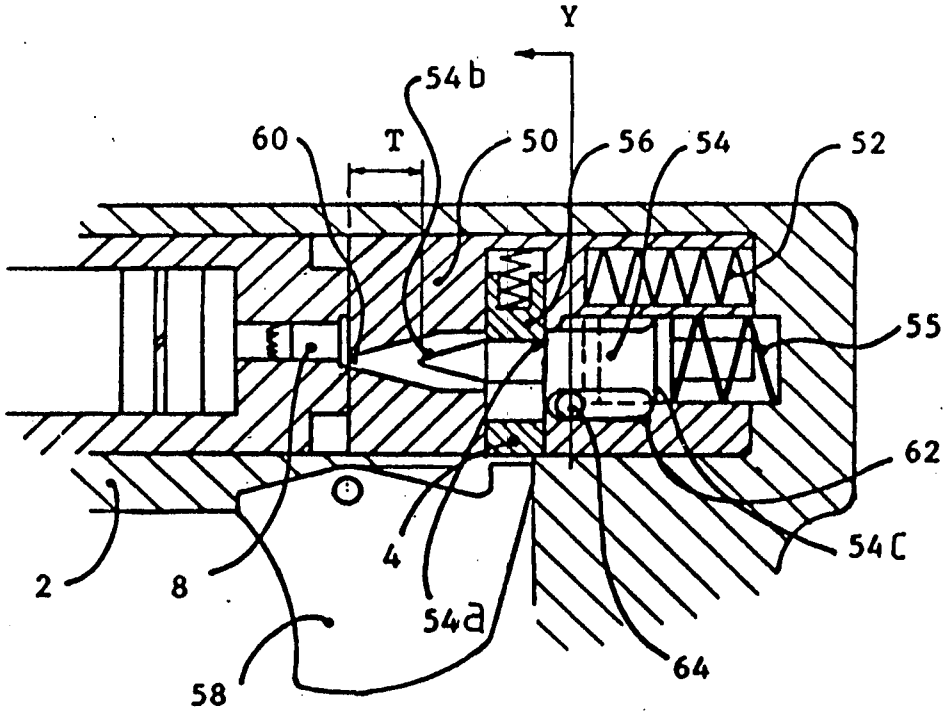
FIG. 8 shows the firing mechanism of the tool.
Figure 7:
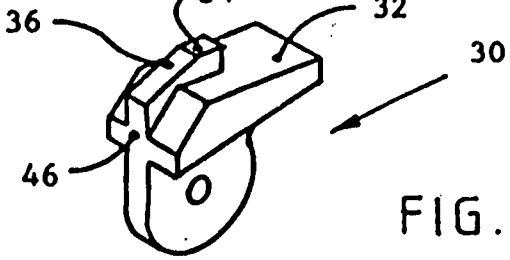
FIG. 7 is a perspective view of a retractor pawl.

With reference to FIGS. 8 and 9, the firing mechanism of the receiver assembly comprises a block 50 mounted for sliding movement in the receiver assembly and which carries the major components of the mechanism. the block 50 is biased forwardly by means of a compression spring 52. the block 50 carries a firing pin 54 loaded by means of a compression spring 55, the pin 54 being held in a cocked position by means of a spring-biased gate 56, which engages a shoulder 54*a* on the pin 54. When the gate 56 is displaced by operation of the trigger 58 the firing pin 54 is propelled forwardly under its spring bias so that its tip 54*b* projects through an aperture 60 at the front of the block 50 into engagement with the case of the charge 8 carried at the rear of the barrel 2 in the ready-to-fire position. After firing, the firing pin 54 is reset by the forward movement of the barrel 2 as will now be described.

When the barrel is moved forwardly to reset the piston 4 and permit loading of a fresh charge as previously described, the block 50 together with the firing pin 54 is moved forwardly by the compression springs 52 and 55 to a forward stop position defined by engagement of a rear stop surface 62 of the block 50 with a transverse stop pin 64 which extends through the block 50 to be anchored at each end in the body of the receiver assembly as shown in FIG. 9. The head 54*c* of the firing pin 54 also engages the stop pin 64 in the forward stop positioon. In this position, the shoulder 54*a* of the firing pin 54 is rearwardly of the gate 56 and the gate has moved under its spring bias into contact with the reduced-diameter front end portion of the firing pin 54. Upon subsequent rearwards movement of the barrel 2, the rear face of the barrel 2 engages the front face of the block 50 and pushes the block backwards. The block 50 will move relative to the firing pin 54 until the gate 56 contacts the shoulder 54*a* of the firing pin and continued rearwards movement of the block 50 will carry the firing pin 54 backwards against the bias of the spring 55 to re-cock the pin.

In the mechanism described, the single stop pin 64 acts as a forward stop for both the block 50 and the firing pin 54 and leads to a significantly simplified construction in comparison with previously proposed mechanisms which incorporate separate stops.

The embodiment has been described by way of example only and modifications are possible within the scope of the invention.

I claim:

1. An explosively-actuated tool for setting a fastener into a substrate, comprising a body, a barrel containing a firing piston operative upon detonation of an explosive charge to drive a fastener in the forward end of the barrel, said barrel being movable in the body from a rear position in which the tool is ready to fire to a forward position in which a breach is opened for loading of a fresh charge, said barrel including a longitudinal slot closed at its forward and rear ends and opening into the interior of the barrel, stop means movable between an operative position in which the stop means extends through the slot in the barrel into the inteior of the barrel to engage the piston during the forward movement of the barrel to reset the piston rearwardly relative to the barrel in preparation for the next firing, and a retracted position withdrawn from the slot in the barrel upon subsequent rearwards movement of the barrel to close the breach, the retracted stop means being located forwardly of the forward end of the slot when the barrel is in its rear position, means for urging said stop means to its retracted position upon movement of said barrel into its rear position, means for moving said stop means to its operational position upon movement of said barrel toward its forward position, a shoulder on said barrel, and a forward stop on the body, said forward stop on the body being engageable with said shoulder on the barrel in the forward position of the barrel to define a forward stopped position for the barrel, said stop means being spaced forwardly from the rear end of the slot when the barrel is in its forward stopped position for preventing engagement of said stop means with said rear end of said slot upon the interengagement of the said shoulder on said barrel and said forward stop on said body if said barrel is thrust forward.

2. The tool according to claim 1, wherein the movement of said stop means includes pivotal movement about a pivot axis.

3. The tool according to claim 1, wherein the interengagement of the said shoulder on said barrel and siad forward stop on said body prevents the rear end of the slot from impacting against the stop means when said barrel is thrust forward.

4. The tool according to claim 1, wherein the means for urging said stop means is a spring.

5. The tool according to claim 1, wherein the means for urging said stop means is resiliently biased towards its operative position and said stop means further comprises a guide portion adapted to engage the external surface of the barrel in the operative position, a stop portion projecting from the guide portion and extending through the slot in the operative position, and a ramp extending through the slot in the operative positoiin, and a ramp portion engageable with the forward end of the slot during movement of the barrel to cause pivotal movement of the stop means to its retracted position as the forward end of the slot passes the stop means during rearwards movement of the barrel to close the breach.

6. The tool according to claim 5, wherein the guide portion comprises a guide surface adapted to engage the external surface of the barrel at each side of the longitudinal slot in the barrel when the stop means is in its operative position, said guide surface having opposed longitudinal sides, and wherein the stop portion extends from a part of the guide portion intermediate the longitudinal sides.

7. A tool according to claim 5, wherein the guide portion and the stop portion are on the same side of the pivot axis of the stop means.

8. A tool according to claim 6, wherein the guide portion and the stop portion are on the same side of the pivot axis of the stop means.

* * * * *

UNITED STATES PATENT AND TRADEMARK OFFICE

CERTIFICATE OF CORRECTION

PATENT NO. : 5,048,740

DATED : September 17, 1991

INVENTOR(S) : Richard J. Beton

It is certified that error appears in the above-identified patent and that said Letters Patent is hereby corrected as shown below:

Column 4, line 34, Claim 1, "inteior" should be --interior--.

Column 4, line 61, Claim 3, "siad" should be --said--.

Signed and Sealed this

Twelfth Day of October, 1993

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,048,740
DATED : September 17, 1991
INVENTOR(S) : Richard J. Beton It is certified that error appears in the above-indentified patent and that said Letters Patent is hereby corrected as shown below:

Column 4, line 34, claim 1, "inteior" should be --interior --.

Column 4, line 61, claim 3, "siad" should be --said --.

Column 5, lines 6-7, claim 5, delete "extending through the slot in the operative Positoun, and a ramp".

This certificate supersedes Certificate of Correction issued October 12, 1993.

Signed and Sealed this

First Day of March, 1994

Bruce Lehman

*Attest:*

BRUCE LEHMAN

*Attesting Officer*

*Commissioner of Patents and Trademarks*